US007685675B2

(12) United States Patent
Jung et al.

(10) Patent No.: US 7,685,675 B2
(45) Date of Patent: Mar. 30, 2010

(54) HANDLE MOUNTING DEVICE FOR USE IN REFRIGERATOR

(75) Inventors: Sang-Ho Jung, Gimhae (KR); Won-Sik Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 1271 days.

(21) Appl. No.: 10/300,838

(22) Filed: Nov. 21, 2002

(65) Prior Publication Data

US 2003/0093876 A1 May 22, 2003

(30) Foreign Application Priority Data

Nov. 21, 2001 (KR) ..... 10-2001-0072751
Dec. 21, 2001 (KR) ..... 10-2001-0082974

(51) Int. Cl.
*A47B 95/02* (2006.01)
*A45C 13/22* (2006.01)

(52) U.S. Cl. ..... 16/110.1; 16/412; 16/436; 16/444; 403/11; 403/13; 403/390; 312/403; 312/348.6

(58) Field of Classification Search ..... 16/412, 16/413, 110.1, 436, 444, DIG. 41; 403/11, 403/13, 390; 312/405, 348.6, 403
See application file for complete search history.

(56) References Cited

U.S. PATENT DOCUMENTS 3,995,349 A * 12/1976 Roberts et al. ..... 16/412
4,138,765 A * 2/1979 Yamazaki et al. ..... 16/412
4,745,656 A * 5/1988 Revlett ..... 16/412
5,144,718 A * 9/1992 Ozawa ..... 16/412
5,440,783 A * 8/1995 Allardyce et al. ..... 16/110.1
5,493,756 A * 2/1996 Shanok et al. ..... 16/412
5,632,062 A * 5/1997 Katz et al. ..... 16/412
5,797,164 A * 8/1998 Donaghy ..... 16/412
5,855,445 A * 1/1999 Ikeshima et al. ..... 403/14
5,860,538 A * 1/1999 Duero et al. ..... 211/123
6,174,070 B1 * 1/2001 Takamura et al. ..... 362/183
6,317,930 B1 * 11/2001 Hung ..... 16/430
6,430,780 B1 * 8/2002 Kim et al. ..... 16/412
6,513,199 B1 * 2/2003 Cheng ..... 16/436
6,553,629 B2 * 4/2003 Grady et al. ..... 16/444

FOREIGN PATENT DOCUMENTS

JP 60-188988 U 12/1985
JP 05-014455 U 2/1993
JP 08-047442 A 2/1996

* cited by examiner

*Primary Examiner*—Victor Batson
*Assistant Examiner*—David C Reese
(74) *Attorney, Agent, or Firm*—Birch, Stewart, Kolasch & Birch, LLP

(57) ABSTRACT

The present invention relates to a handle mounting device for use in a refrigerator for mounting a refrigerator door handle onto an outer surface of a door of the refrigerator. The handle mounting device of the present invention is used to mount a handle 50 for opening and closing the door onto an outer surface 40 of the door. The handle mounting device includes a mounting ring member 70 into which one end of handle 50 is fitted and of which a surface is plated, and a handle base 60 which is made of synthetic resin material and of which one end is fitted into the mounting ring member 70 and the other end is fixed onto the outer surface 40 of the door. Further, one end of the handle base 60 is fitted into the handle 50 fitted into the mounting ring member 70.

1 Claim, 3 Drawing Sheets

HANDLE MOUNTING DEVICE FOR USE IN REFRIGERATOR

BACKGROUND OF THE INVENTION

1. Field of the Invention

The present invention relates to a handle mounting device for use in a refrigerator, and more particularly, to a handle mounting device for use in a refrigerator which is constructed such that the cost of materials can be reduced and a current leakage problem due to plating can also be solved by reducing an area of a part to be plated in the handle mounting device.

2. Description of the Prior Art

A refrigerating or freezing chamber within a refrigerator is configured to allow foodstuffs to be put into and picked out of the chamber by means of opening/closing of a door of the refrigerator. A handle, which a user can grasp when opening and/or closing the door, is mounted to an outer surface of the door. FIG. 1 shows a conventional handle mounting structure. As shown in the figure, a handle 20 is installed on an outer surface 10 of the door of the refrigerator, which is made of a flat steel plate. Further, the handle 20 is manufactured in the form of a pipe, for example, through an aluminum extrusion process.

In order to fix the handle 20 to the outer surface 10 of the door, a handle base 12 has been heretofore utilized. The handle base 12 is manufactured by injection molding synthetic resin material, and is also configured such that one end of the handle 20 is fitted into one side (left side in the figure) of the handle base while the other side thereof is fixed to the outer surface 10 of the door. When the handle 20 is fixed to the outer surface 10 of the door by using the handle base 12, the handle base 12 is coupled with opposite ends of the handle 20.

Then, the handle 20 is fitted into and fastened with a screw Sa to the left side of the handle base 12 so that its locked state can be maintained. A right side of the handle base 12 is fixed with a screw Sb to the outer surface of the door so that its fixed state can be maintained.

Since the handle base 12 injection molded from the synthetic resin material becomes a portion of an external surface of the refrigerator door, a surface thereof should be plated for the sake of a good external appearance. In addition, such a plating process is performed throughout the entire surface of the handle base 12.

With the conventional constitution as such, some problems are produced out as follows.

In such a conventional technique, the entire surface of the handle base 12 is plated. It is not economically preferable from the viewpoint of the plating costs. That is, since an area to be plated becomes large, there is a disadvantage in that entire production costs are increased due to the plating process.

Further, if the plating process is performed on the surface of the handle base 12, the surface exhibits a conductive characteristic. At this time, since the handle base can be electrically connected through the screw Sb with the outer surface 10 of the door made of the steel plate, a current leakage problem in the refrigerator may be produced.

SUMMARY OF THE INVENTION

The present invention is conceived to solve the problems in the prior art. An object of the present invention is to provide a handle mounting device for use in a refrigerator capable of reducing the cost of materials due to reduction in an area to be plated.

Another object of the present invention is to provide a handle mounting device for use in a refrigerator capable of completely preventing occurrence of a problem of current leakage through a door handle.

According to an aspect of the present invention for achieving the objects, there is provided a handle mounting device for use in a refrigerator for mounting a handle for opening and closing a door onto an outer surface of the door. The handle mounting device comprises a mounting ring member into which one end of the handle is fitted and of which surface is plated, and a handle base which is made of synthetic resin material and of which one end is fitted into the mounting ring member and the other end is fixed onto the outer surface of the door.

Preferably, one end of the handle base is fitted into the handle inserted into the mounting ring member.

More preferably, the handle and the handle base are fastened within the mounting ring member to one another with a single screw.

In addition, the other end of the handle base may be fastened to the outer surface of the door with a screw.

Furthermore, a guide groove may be formed on an inner circumferential surface of the mounting ring member, and a guide protrusion to be inserted into the guide groove may be formed on the inserted portion of the handle base. Thus, the mounting ring member and the handle base can be more easily coupled with each other.

Preferably, a protruding ring is formed on the inner circumferential surface of the mounting ring member and the guide groove is concavely formed at a portion of the protruding ring.

More preferably, the guide protrusion to be inserted into the guide groove is stepped to include an upper step and a lower step. Further, the lower step may be inserted into the guide groove and the upper step may come into contact with the protruding ring. Thus, a suitable depth of insertion of the handle base into the mounting ring member can be determined.

According to the handle mounting device of the present invention, the cost of materials can be reduced since only a surface of the mounting ring member is required to be plated. Further, since the handle base need not be plated, the current leakage problem, which may be produced when the handle base is fixed with the screw onto the outer surface of the door made of the steel plate, can be completely solved.

BRIEF DESCRIPTION OF THE DRAWINGS

The above and other objects, advantages and features of the present invention will become apparent from the following description of preferred embodiments given in conjunction with the accompanying drawings, in which.

DETAILED DESCRIPTION OF THE INVENTION

Hereinafter, preferred embodiments of the present invention will be explained in detail with reference to the accompanying drawings.

Figure 1:
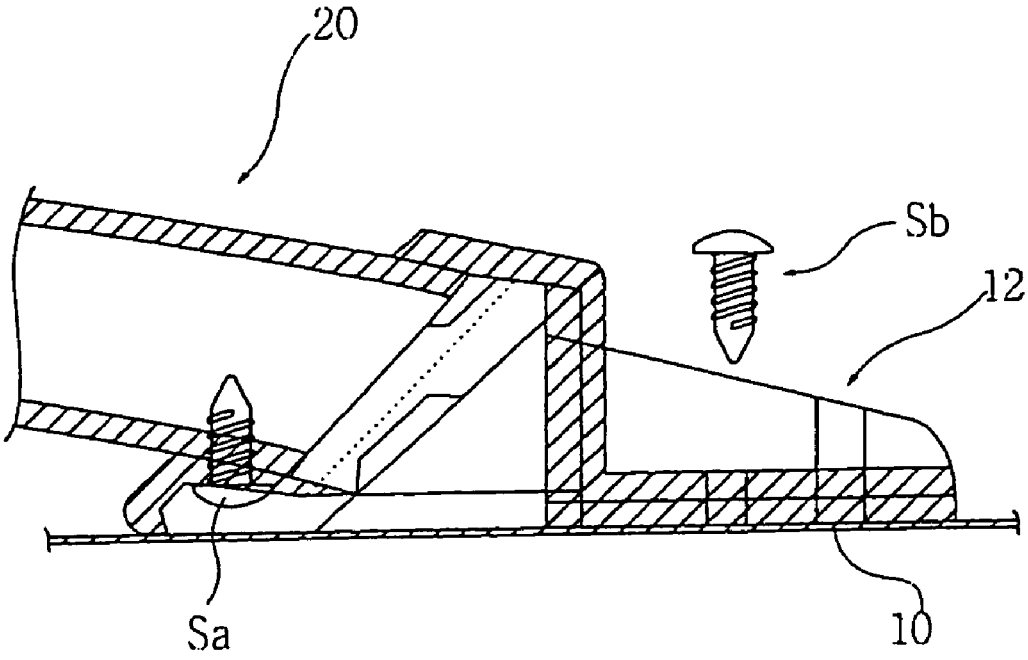
FIG. 1 CONVENTIONAL ART
FIG. 1 is a partial cross-sectional view showing a state where a handle is mounted according to a prior art.
Figure 2:
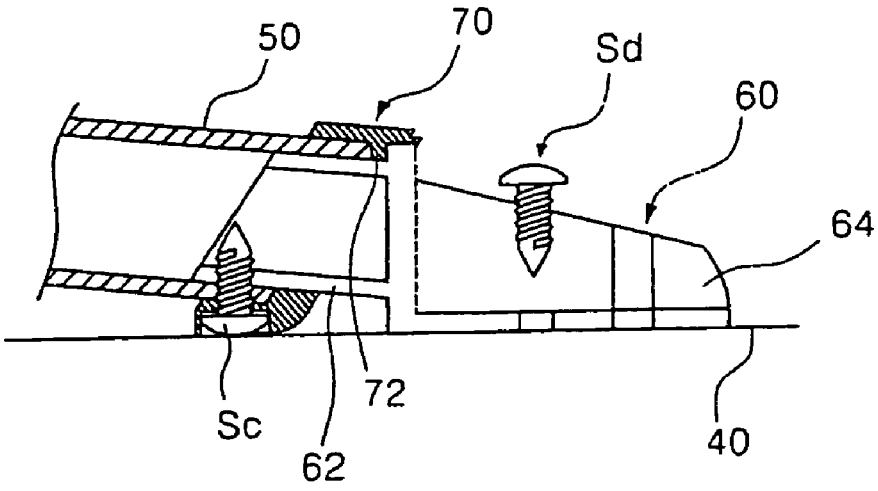
FIG. 2 is a partial cross-sectional view showing a state where a handle is mounted according to a preferred embodiment of the present invention.
Figure 3:
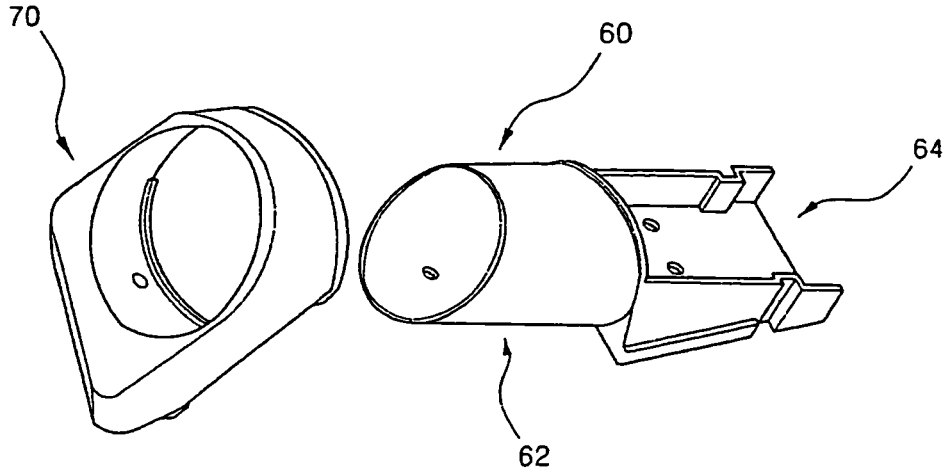
FIG. 3 is an exploded perspective view of a mounting ring member and a handle base according to the preferred embodiment of the present invention.

As shown in FIGS. 2 and 3, a handle mounting device of the present invention comprises a handle 50 which is manufactured through an aluminum extrusion process and the like and is gripped by a user, a mounting ring member 70 into which one end of the handle 50 is fitted and of which external surface is plated, and a handle base 60 of which one end is fitted into the mounting ring member 70 and the other end is fixed to an outer surface 40 of a door of a refrigerator.

Although only a portion at one side of the handle mounting device including the handle 50, the handle base 60 and the like is shown in the figures, it will be easily understood that it can be substantially constructed in the same manner as that at the other side thereof.

The handle 50 is a portion that the user grips when opening and/or closing the door of the refrigerator. For example, the handle is formed through an aluminum extrusion process. The mounting ring member 70 into which the one end of the handle 50 (right end thereof in the figures) is fitted is substantially formed to take a ring shape through an injection molding process. Further, a surface of the mounting ring member 70 should be plated because the mounting ring member is exposed toward the outside even after the handle 50 has been completely mounted to the outer surface 40 of the refrigerator door.

According to the present invention, since only the mounting ring member 70 is plated, an area to be plated is remarkably reduced as compared with the prior art. Thus, the present invention is substantially advantageous in view of the cost of materials. Further, it is preferred that the right end of the handle 50 be fitted into and come into close contact with an inner circumferential surface of the mounting ring member 70 to be supported without any play. In order to adjust the degree of insertion of the right end of the handle 50, a protrusion 72 may be formed on the inner circumferential surface of the mounting ring member 70. If the handle 50 is fitted into the mounting ring member 70, the right end of the handle 50 comes into contact with the protrusion 72 and the degree of insertion of the right end of the handle 50 into the mounting ring member 70 will be determined accordingly.

Further, the handle base 60 of the present invention is injection molded from the synthetic resin material, and comprises an insert portion 62 inserted into the mounting ring member 70 at an end thereof (a left end in the figure) and a fixing portion 64 fixed onto the outer surface of the door.

When the insert portion 62 of the handle base 60 is inserted into the mounting ring member 70, it is more preferable to be inserted into the interior of the right end of the handle 50 which has been fitted into the mounting ring member 70, as shown in FIG. 2. Then, the handle 50, the mounting ring member 70 and the handle base 60 are fastened with a single screw Sc, and thus, the three members can be completely fixed to one another.

The fixing portion 64 of the handle base 60 is fastened with a screw Sd and completely fixed onto the outer surface 40 of the door which is made of the steel plate. Since the handle base 60 is an insulator made of the synthetic resin material, there is no risk of the occurrence of the current leakage problem even though the handle base 60 is fastened to the outer surface 40 of the door with the screw Sd.

Furthermore, a right end of the handle base 60, which is fixed onto the outer surface 40 of the door with the screw Sd, is covered with an additional cap (not shown) so as not to mar an external appearance of the refrigerator.

According to the present invention, as described above, the handle base 60 and the mounting ring member 70 are separately manufactured, and they are used to mount the handle 50 to the outer surface 40 of the door. Since the mounting ring member 70 is a conspicuous portion, the surface thereof should be plated.

Figure 4:
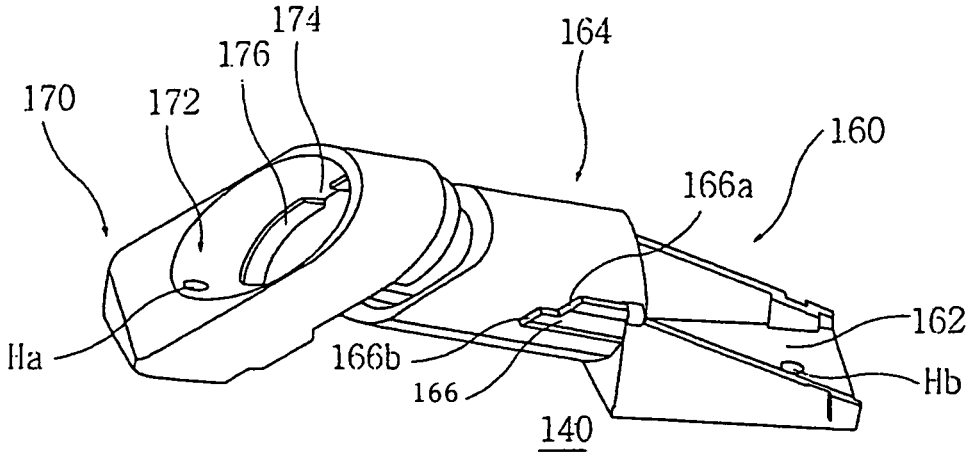
FIG. 4 is an exploded perspective view of a mounting ring member and a handle base according to another preferred embodiment of the present invention.

Hereinafter, another preferred embodiment of the present invention will be described with reference to FIGS. 4 and 5.

According to this preferred embodiment, the engagement of the handle base with the aforementioned mounting ring member can be made more easily and also maintained more firmly at their engaged state.

As shown in the figures, a handle mounting device according to the preferred embodiment of the present invention comprises a mounting ring member 170 and a handle base 160. A handle 150, which is manufactured through the aluminum extrusion process and the like in the form of a pipe, is fitted into the mounting ring member 170 from a left side in the figures. One end of the handle base 160 is fitted into the mounting ring member 170, while the other end thereof is fixed onto an outer surface 140 of the door. Although only a portion at one side of the handle mounting device including the handle 150, the handle base 160 and the like is shown in the figures, it will be easily understood that it can be substantially constructed in the same manner as that at the other side thereof.

The handle 150 is formed through the aluminum extrusion process and the like to take a hollow shape. The handle 150 is a portion that a user grips when opening and/or closing the refrigerator door. The mounting ring member 170 into which one end of the handle 150 is fitted is manufactured generally in the form of a ring by injection molding synthetic resin material. Further, a surface of the mounting ring member 170 is plated because the mounting ring member is exposed toward the outside even after the handle 150 has been completely mounted to the outer surface 140 of the refrigerator door.

Furthermore, the mounting ring member 170 includes a fitting hole 172 into which the one end of the handle 150 can be fitted. At least ones guide groove 174 is formed on an inner circumferential surface of the fitting hole 172 in a longitudinal direction. In the illustrated preferred embodiment, the guide groove 174 is formed concavely at a portion of a protruding ring 176 protruding from the inner circumferential surface of the fitting hole 172. Alternatively, the guide groove 174 may be formed directly on the inner circumferential surface of the fitting hole 172. Further, a screw-fastening hole Ha through which a screw is fastened is formed at one side of the mounting ring member 170.

The handle base 160 comprises a fixing portion 162 which comes into contact with and fixed to the outer surface 140 of the refrigerator door, and an insert portion 164 which is extended leftward from the fixing portion 162 and can be fitted into the fitting hole 172. In the fixing portion 162 is formed a fastening hole Hb into which the screw Sd is fastened so that the fixing portion 162 can be brought into close contact with and fixed to the outer surface 140 of the door.

In addition, at least one guide protrusion 166 with a predetermined length in an insertion direction of the handle base into the mounting ring member is formed on an outer circumferential surface of the inserting portion 164 of the handle base 160. The guide protrusion 166 protrudes from the outer circumferential surface of the inserting portion 164 so that it can be inserted into the guide groove 174 of the fitting hole 172. Therefore, if the guide protrusion 166 is inserted into the guide groove 174, the inserting portion 164 can neither play nor rotate within the mounting ring member 170.

In the illustrated embodiment, the guide protrusion 166 is stepped to include an upper step 166*a* and a lower step 166*b*. If the lower step 166*b* of the guide protrusion is inserted into the guide groove 174, the upper step 166*a* comes into contact with a lateral surface of the protruding ring 176 formed to protrude from the inner circumferential surface of the mounting ring member 170, and thus, the guide protrusion 166 cannot further inserted into the mounting ring member. Therefore, if the guide protrusion 166 is configured to include two steps as shown in the figures, the handle base 160 can be prevented from being excessively inserted into the mounting ring member 170 since the upper step 166*a* comes into contact with the protruding ring 176 formed on the inner circumferential surface of the mounting ring member 170.

Furthermore, the most suitable degree of insertion of the handle 150 can be achieved since the end of the handle 150 inserted leftward into the mounting ring member 170 can also come into contact with the protruding ring 176 formed on the inner circumferential surface of the mounting ring member 170.

Figure 5:
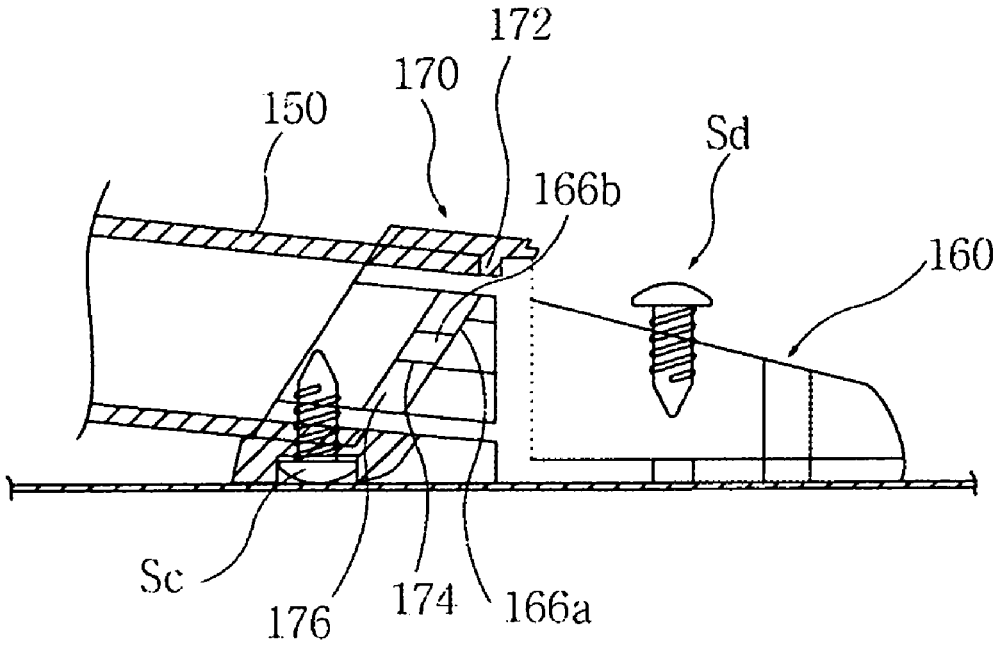
FIG. 5 a partial cross-sectional view showing a state where a handle is mounted according to the preferred embodiment of the present invention.

Referring to FIG. 5, in a state where the handle 150 has been inserted into the mounting ring member 170 from the left to the right and the handle base 160 has been inserted into the mounting ring member 170 from the right to the left, the three members are fastened with the single screw Sc. Therefore, the three members, i.e. the handle 150, the mounting ring member 170 and the handle base 160 can be completely fixed to one another. Then, the fixing portion 162 of the handle base 160 is fastened with the screw Sd to the outer surface 140 of the door made of the steel plate, and is thus completely fixed thereto. Since the handle base 160 is an insulator made of the synthetic resin material, there is no risk of the occurrence of the current leakage even though the handle base 160 is fastened to the outer surface 140 of the door with the screw Sd.

Although not shown in the figures, a right portion of the handle base 160, which is fixed onto the outer surface 140 of the door with the screw Sd, is covered with an additional cap (not shown) so as not to mar an external appearance of the refrigerator.

According to the present invention, the following advantages can be expected.

First, since only the mounting ring member is plated, the area to be plated is substantially remarkably reduced as compared with the prior art. Thus, there is a more favorable advantage in view of the cost of materials.

Further, the handle base, which is fixed to the outer surface of the door made of the steel plate, is formed out of the synthetic resin material, and the surface of the handle base is not plated. Thus, there is a safety advantage in that the current leakage problem is not produced at all even though the handle base is fastened with the screw Sd to the outer surface of the door.

Furthermore, when the handle base is coupled to the mounting ring member according to the second embodiment of the present invention, they can be more easily coupled to each other by means of the guide protrusion and the guide groove. Thus, there is a further advantage in that their coupled and fixed state can be maintained more firmly.

Although the present invention has been described in connection with the preferred embodiments with reference to the accompanying drawings, the preferred embodiments are intended not to limit the invention but to exemplify a best mode of the present invention. It will be understood by those skilled in the art that various changes or modifications may be made thereto without departing from the spirit and scope of the invention. Therefore, the present invention is defined only by the appended claims which should be construed as covering such changes or modifications.

What is claimed is:

1. A handle mounting device for use in a refrigerator for mounting a bar-shaped handle onto an outer surface of a door of the refrigerator, which a user grips when opening and/or closing the door, comprising:

a mounting ring member into which one end of the handle is coaxially fitted and of which a surface is plated; and a handle base, which is made of synthetic resin material and includes an inserting portion fitted into the mounting ring member and a fixing portion fixed onto the outer surface of the door, wherein the handle is manufactured in the form of a pipe and the inserting portion of the handle base is fitted into the handle inserted into the mounting ring member, wherein the handle, the handle base and the mounting ring member are fastened to one another with a single screw which penetrates the handle, the handle base and mounting ring.

* * * * *